US008550301B2

(12) United States Patent
Szymanski

(10) Patent No.: US 8,550,301 B2
(45) Date of Patent: Oct. 8, 2013

(54) LIQUID DISPENSING APPARATUS

(76) Inventor: Marek Szymanski, Kellyville (AU)

( * ) Notice: Subject to any disclaimer, the term of this patent is extended or adjusted under 35 U.S.C. 154(b) by 691 days.

(21) Appl. No.: 12/614,194

(22) Filed: Nov. 6, 2009

(65) Prior Publication Data

US 2010/0108717 A1 May 6, 2010

Related U.S. Application Data

(63) Continuation of application No. PCT/AU2008/000554, filed on Apr. 21, 2008.

(30) Foreign Application Priority Data

May 7, 2007 (AU) ..... 2007902379
Mar. 25, 2008 (AU) ..... 2008901410

(51) Int. Cl.
*B65D 35/34* (2006.01)
*G06K 15/00* (2006.01)
*G01F 23/20* (2006.01)
*B65B 1/30* (2006.01)

(52) U.S. Cl.
USPC ..... 222/100; 222/63; 222/102; 250/577; 250/900; 73/296; 73/863.01; 356/627; 141/83

(58) Field of Classification Search
USPC ..... 222/63, 333, 100, 101, 102, 99, 55; 118/663, 688, 689, 690, 691; 141/83; 250/341.1, 330, 573–577, 900; 73/863.01, 73/863.02, 291, 296; 356/627
See application file for complete search history.

(56) References Cited

U.S. PATENT DOCUMENTS

| | | | | |
|---|---|---|---|---|
| 2,542,678 | A * | 2/1951 | Keefer | 222/98 |
| 2,872,077 | A * | 2/1959 | Heck | 222/100 |
| 3,187,951 | A * | 6/1965 | Hardman et al. | 222/102 |
| 3,204,824 | A * | 9/1965 | McGraw, Jr. | 222/100 |
| 3,471,668 | A * | 10/1969 | Wilkes | 200/503 |
| 3,670,926 | A * | 6/1972 | Hill | 222/47 |
| 4,010,871 | A | 3/1977 | Broadie | |
| 4,132,330 | A | 1/1979 | Rauscher et al. | |

(Continued)

FOREIGN PATENT DOCUMENTS

| | | | |
|---|---|---|---|
| WO | 9216425 | A1 | 10/1992 |
| WO | 9504561 | A1 | 2/1995 |
| WO | 2007032625 | A1 | 3/2007 |

OTHER PUBLICATIONS

International Search Report for PCT/AU2008/000554 dated Jul. 4, 2008.

*Primary Examiner* — Kevin P Shaver
*Assistant Examiner* — Stephanie E Williams
(74) *Attorney, Agent, or Firm* — Mayback & Hoffman, P.A.; Gregory L. Mayback; Thomas Bethea

(57) ABSTRACT

This disclosure relates to a liquid dispensing apparatus for dispensing a liquid from a flexible bag. The apparatus has a support for supporting the flexible bag in use and a mounting adapted for receiving a proximal portion of the flexible bag, for progressive movement relative to the support towards an outlet located at a distal portion of the flexible bag. As the flexible bag is progressively wound up, liquid is squeezed from the proximal portion to the distal portion to dispense liquid from the outlet in a controlled manner in use. This allows desired and precise dosage portions of liquid to be squeezed from the bag and direct dosing from the flexible bag amongst other advantages.

31 Claims, 12 Drawing Sheets

(56) References Cited

U.S. PATENT DOCUMENTS 4,421,251 A * 12/1983 Namdari et al. ..... 222/99
4,450,982 A * 5/1984 Ferreira ..... 222/93
4,550,982 A 11/1985 Hirai
5,203,473 A * 4/1993 Willey ..... 222/94
5,248,061 A * 9/1993 Weiselfish et al. ..... 222/63
6,334,165 B1 12/2001 Barenys et al.
6,364,165 B2 4/2002 Sampson et al.
6,401,977 B1 6/2002 Ross, III

* cited by examiner

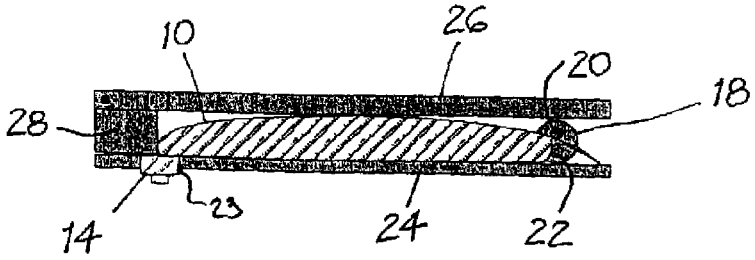
Fig. 3
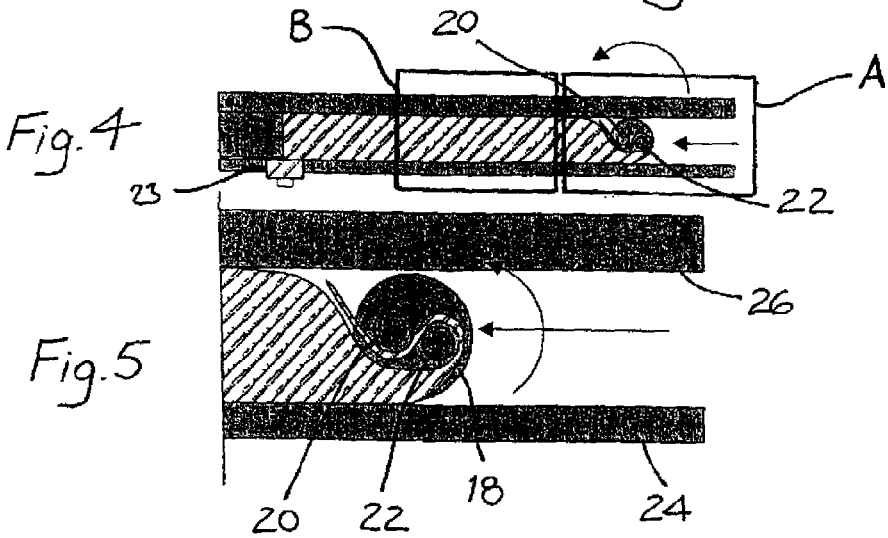
Fig. 4
Fig. 5
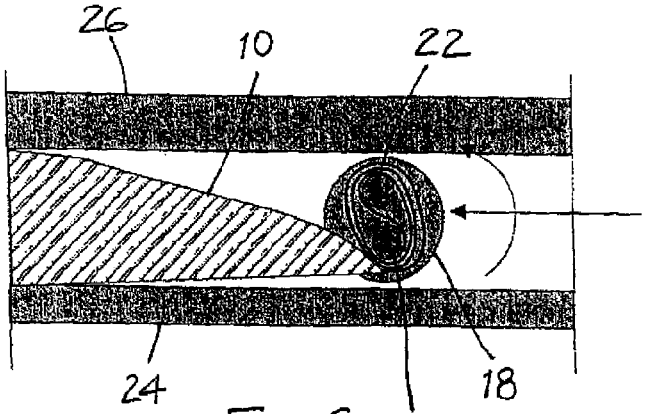
Fig. 6

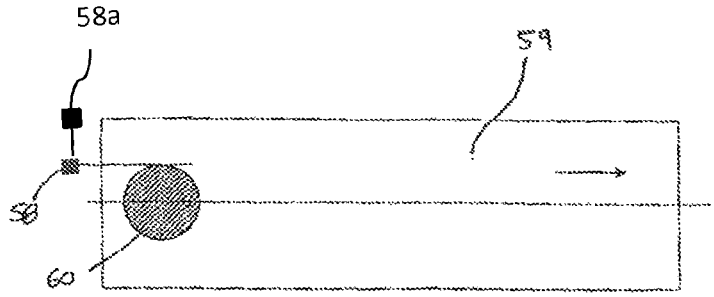
FIG. 20
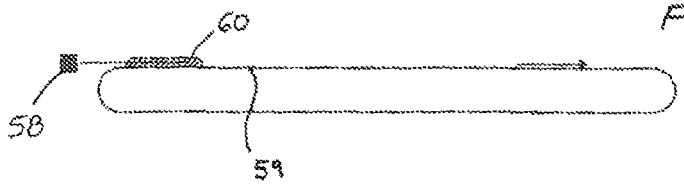
FIG. 21
FIG. 22
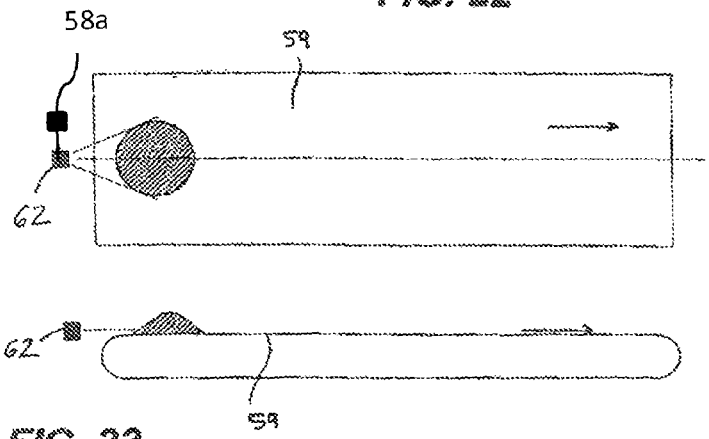
FIG. 23
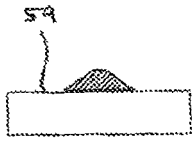
FIG. 24
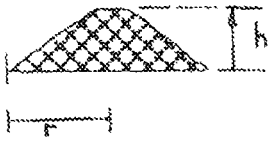
FIG. 25

LIQUID DISPENSING APPARATUS

CROSS-REFERENCE TO RELATED APPLICATIONS

This application claims the priority, under 35 U.S.C. §§119, 120, 363, and 371, of Australian Patent Application Nos. AU2007902379, filed May 7, 2007, and AU2008901410, filed Mar. 25, 2008, and International Application No. PCT/AU2008/000554, filed Apr. 21, 2008, which designated the United States and was published in English; the prior applications are herewith incorporated by reference in their entirety.

STATEMENT REGARDING FEDERALLY SPONSORED RESEARCH OR DEVELOPMENT n/a

FIELD OF THE INVENTION

The present invention relates to a liquid dispensing apparatus for dispensing liquid from a flexible bag.

While the invention will hereinafter be described by reference to its use in dispensing food products or components, it should be noted that the invention is not necessarily limited to this particular field of use but has application in other fields, such as the dispensing of desired dosage amounts of beverages, industrial chemicals, and liquid preparations for use in medical, pharmaceutical and personal care.

BACKGROUND OF THE INVENTION

The following discussion of the prior art is not to be regarded as an admission that what is discussed is common general knowledge in this field.

Plastic film bags have become a common packaging method for food and other products, including liquid food products. Such bags offer substantial benefits over traditional rigid containers such as bottles, cans, pails, drums or tanks. The bags are usually fitted with spouts and caps. Fitments can be used for filling product into the bag, pumping product out of the bag, or both.

The dispensing systems for such bags commonly are of two types. A first type employs a valve arrangement and is gravity driven (e.g. a wine cask), whilst a second type uses a pump system (e.g. a peristaltic pump) with or without a valve arrangement. There are numerous disadvantages associated with prior art dispensing systems including:

1. Dispensing accurate doses of liquid at a relatively fast rate is difficult. This is particularly the case if the liquid is viscous and not 'runny'. The speed of peristaltic pumps is limited because the flexible tube needs to return to its original shape between pumps (i.e. the pumps need to be spaced in time to allow this). Peristaltic pumps are relatively power inefficient and thus can be relatively costly to operate. Furthermore, peristaltic pump tubes wear out regularly and so need to be replaced. The accuracy of peristaltic pumps is also limited since the rate of volume throughput is a function of hydraulic pressure (which can vary depending on a range of factors). It is acknowledged that slowly dispensing liquid to improve accuracy is possible but this may impact heavily on the commercial feasibility of such a system. Alternatively, machines that can dispense viscous liquid at a fast rate tend to be complex and expensive.

2. In the case of systems incorporating a pump, liquid can remain in the pump and/or the pump may not be strong enough to suck the last portions of liquid out of the bag. Failure to substantially completely empty the bag results in wastage of liquid, and if the bag is to be reused, the hygiene problem discussed below.
3. They can leave portions of liquid in or on components of the dispensing system. Because of this, the system needs to be regularly cleaned to maintain hygiene and to mitigate the risk of contamination of the liquid dispensed by the system. Even if the liquid receptacle takes a normally closed or sealed form, entry to possible contaminants would be difficult to avoid when the receptacle is refilled. A positive displacement piston type pump is a good example of a type of pump that is generally difficult to clean.
4. They are relatively complex in construction.

The present invention seeks to provide a liquid dispensing apparatus which will overcome or substantially ameliorate at least one of the deficiencies of the prior art, or to at least provide an alternative.

SUMMARY OF THE INVENTION

According to a first aspect of the present invention, a liquid dispensing apparatus for dispensing a liquid from a flexible bag is provided, comprising:

a support for supporting the flexible bag in use, a mounting adapted for receiving a proximal portion of the flexible bag, for progressive movement relative to the support towards an outlet of the flexible bag located at a distal portion of the flexible bag, such that the flexible bag is progressively wound up and thus the liquid is squeezed from the proximal portion to the distal portion to dispense liquid from the outlet in a controlled manner in use.

One advantage of embodiments of the liquid dispensing apparatus is that it can dispense desired & precise dosage portions of liquid because the liquid is gradually squeezed out in a controlled manner. This stands in contrast, for example, to fluid being dispensed under gravity or under action of a pump where volume flow rate can be dependent on hydraulic pressure.

The controlled squeezing from distal portion to proximal portion of the bag can be carried out at varying speeds according to requirement, and accuracy of dosing can be maintained. Thus, embodiments of the present invention allow dispensing of accurate doses of liquid at a relatively fast rate, substantially irrelevant of the viscosity of the liquid (within a certain range of viscosities). Thus, embodiments of the present invention are well adapted to production lines and production processes. One example of such a production process is the process of preparing a food item (e.g. a pancake). A speedy process will lead to better rates of production of the food items and to greater customer satisfaction.

Another advantage of embodiments of the liquid dispensing apparatus is that it is able to substantially completely empty the flexible bag because the bag is maintained in tension as it is wound up from the tail to the nozzle of the bag. This results in less wastage of liquid and subsequently to a reduction in the costs associated with the provision of the liquid.

Another advantage of embodiments of the liquid dispensing apparatus is that it provides direct dosing from the flexible bag. That is, in normal operation the liquid does not contact any unnecessary surfaces of the dispensing apparatus. For example, in the case that the dispensing apparatus is adapted for dispensing portions of food to be cooked, the food is dispensed directly onto the cooking surface or surfaces. Thus, in the case that the bags are discarded once emptied, the apparatus does not need to be regularly cleaned because the liquid does not contact any other components of the apparatus and therefore is also highly hygienic. The fact that the apparatus is adapted to provide direct dosing from the flexible bag means that a flexible tube (as in peristaltic pumps) or other like wearable parts are not required and hence do not need to be replaced.

The apparatus can also be highly hygienic in embodiments where the contents of the bag remain sealed in the bag until dispensed from the bag. Thus, in the context of preparation of food products, the apparatus stands superior of some prior art in terms of health, safety and contamination considerations. In embodiments that include air-tight sealing of the contents of the bag (whether in solid or liquid state) the product is better preserved and shelf-life is increased. This is particularly advantageous in the case that the apparatus is used to dispense food products because of the relatively short shelf-life of food products.

Another advantage of embodiments of the liquid dispensing apparatus is that it is mechanically simple in construction. This is because a dispensing receptacle and associated components (e.g. an attachment, a cover and/or a stirrer) need not be incorporated into the apparatus. This reduces costs and means that the liquid dispensing apparatus can be manufactured in a more compact form, reducing packaging, packing time, and delivery requirements, if relevant. A mechanically simple construction also means that the system is mechanically efficient. This, in turn, reduces power requirements, and thus cost. A mechanically simple construction also provides greater reliability because there are less parts involved.

Another advantage of embodiments of the liquid dispensing apparatus is that the power requirements are relatively low since the relatively small radius mounting (and bag wrapped therearound) only needs to be wound and thus the electric motor has a strong mechanical advantage or leverage. The reduced power requirements mean that the apparatus is less likely to cause injury to a user and can utilize a smaller/cheaper motor. Furthermore, the apparatus will not use as much power, reducing power costs.

Yet another advantage of embodiments of the liquid dispensing apparatus that utilize a bag which is disposed of once emptied, is that usage is simplified since refilling steps and cleaning steps are not involved. This results in a high level of convenience of use. Convenience for the owner of the machine is further enhanced because bags of liquid or powder (e.g. for mixing with water to make the liquid) can be sent to them, ready or near ready for use. For example, the bag may be connected to the dispensing apparatus in one or two simple steps, and water may be added to the contents of the bag if necessary beforehand.

The arrangement also allows for easy mixing with water as once water has been added to the bag, the bag can be shaken with a lid over the nozzle and then connected to the apparatus once the contents are properly mixed. Furthermore, if the flexible bag is made from a clear material, a user can see whether the contents are properly mixed and, because the flexible bag is flexible, a user can feel whether the contents are properly mixed. If the contents are not properly mixed, then the user can carry out further shaking to mix the contents of the bag.

Preferably, the outlet comprises a nozzle, and the support comprises an aperture for receiving the nozzle in use. Advantageously, the nozzle helps to control and direct the flow of liquid out of the flexible bag in use. In different embodiments, the nozzle may be provided at different locations on the bag but preferably is located at or adjacent the end opposite to the end that is wound up initially. For storage, transportation and delivery a protective cap may be fitted to the nozzle.

Preferably, the nozzle extends through the aperture. In this form, the nozzle takes the form of a protrusion extending outwardly from a main body portion of the flexible bag. Advantageously, the nozzle provides a fitting indicator insomuch as once it is fitted within the aperture in the support, the flexible bag with be correctly positioned on the support, ready to be connected to the mounting. In one embodiment, the nozzle takes the form of a one-way valve which increases hygiene between uses as air or other contaminants cannot enter the flexible bag.

Preferably, the aperture comprises a retainment to releasably retain the nozzle in the aperture. Advantageously, in this embodiment the nozzle is held in the aperture such that it can better provide a reaction force against the pull of the flexible bag as it is progressively wound up. This makes the flexible bag taut which aids the winding up of the bag and enables even better extraction of liquid from the flexible bag.

Preferably, the liquid dispensing apparatus further comprises a drive system for moving the mounting towards the distal portion of the flexible bag, and for progressively winding up the flexible bag from the proximal portion to the distal portion. In some embodiments, the drive system provides automatic squeezing of the flexible bag either in whole or in steps depending on user selection. There is a clear advantage in terms of having the flexible bag squeezed by a drive system (as opposed to the flexible bag being wound up manually) in terms of preciseness of dosage and general ease of use of the liquid dispensing apparatus.

Preferably, the support comprises a lower portion for supporting the flexible bag from below and at least one expansion limiting portion for limiting expansion of the bag in use.

The lower portion is advantageous in that it supports the weight of the bag. If the weight of the bag were not so supported then the bag would need to be supported at its proximal portion by the mounting and at its outlet by an 'outlet support'. In order for the bag to be held in a taut, non-sagging manner (which benefits accurate dosing), the mounting and outlet support would need to provide high opposing forces, which, in turn, would place undue stress on the apparatus.

Provision of both a lower portion and at least one expansion limiting portion to limit expansion of the bag is beneficial in that dosing can be more accurately controlled when bag expansion is reduced. Limiting expansion of the bag in use reduces variation in flow speed at a constant rotational velocity of the mounting.

Preferably, the lower portion is an under surface and the at least one expansion limiting portion is an upper surface spaced above the lower surface and adapted to resist expansion of the flexible bag in use. This embodiment provides a convenient way of limiting expansion of the bag by sandwiching the largest planes of the bag in use.

Preferably, the upper surface is hinge mounted at one end to the support. This allows the mounting and lower portion to be readily accessed in use and thus allows the bag to be readily fitted to or removed from the apparatus.

Preferably, the upper surface includes a protrusion extending downwardly which maintains the nozzle in the aperture. This helps maintain the nozzle in the aperture particularly when the flexible bag is tensioned as the mounting progressively winds up the bag.

Preferably, the mounting is adapted for simultaneous progressive translation towards the distal portion and winding of the flexible bag.

Preferably, the support comprises at least one rail and the mounting comprises at least one roller adapted for rolling along the at least one rail and a reel of variable effective diameter. Advantageously, a reel of variable effective diameter allows the reel to reduce in diameter as tension in the bag increases. This means that the tension will not increase to a level that excessively hinders forward movement of the reel (i.e. towards the outlet of the bag).

Preferably, the reel comprises at least two spaced apart, elongate mounting members that define a slot therebetween for receiving the proximal portion of the flexible bag in use. Advantageously, once the proximal portion of the flexible bag is weaved between the at least two spaced apart mounting members, the flexible bag can be rotated by the mounting members and friction will stop the proximal portion of the bag from sliding out of the slot.

Preferably, at least a portion of at least one of the mounting members is made from a resilient material, such that as the flexible bag is progressively wound around the mounting members, the at least one of the mounting members flexes, and the distance between the mounting members reduces, thus reducing the effective diameter of the reel. Advantageously, this represents a simple and cost-effective manner of providing a variable diameter reel in use.

Preferably, the mounting comprises two rollers and the reel comprises two mounting members and each roller is connected directly or indirectly to adjacent ends of the mounting members.

Preferably, intermediate regions of the mounting members are connected by a biasing arrangement.

Preferably, the biasing arrangement is at least one compression spring.

Preferably, the biasing arrangement is at least one tension spring.

Preferably, the reel comprises at least one shaft and at least one spring interconnecting the at least one shaft and the proximal portion of the flexible bag, such that as the flexible bag is progressively wound up, the at least one spring compresses reducing the effective diameter of the reel.

Preferably, the spring is a spiral spring that surrounds at least a portion of the shaft and has an inner edge mounted to the shaft and an outer edge adapted to be attached to the proximal portion of the flexible bag such that as the flexible bag is progressively wound around the spiral spring, the spiral spring compresses reducing its effective diameter, thus reducing the effective diameter of the reel. Preferably, the drive system is adapted to rotate the or each roller along the or each respective rail.

Preferably, the drive system comprises an electric step motor and a control unit.

Preferably, the support comprises two rails and the mounting comprises two rollers and the reel is mounted between and has ends connected to respective rollers.

Preferably, the rollers and rails include gear teeth that are adapted to mesh with each other thereby ensuring forward movement of the mounting occurs with rotation of the mounting. That is, the inclusion of gear teeth on the rollers and rails ensures the rollers do not slip when moving along the rails.

Preferably, the bag is made from a food grade plastic, elastomeric material, sealed paper, sealed fabric or Teflon.

Preferably, the flexible bag has a variable cross-sectional area such that the dispensing of liquid from the outlet is substantially proportional to progressive winding of the flexible bag in use.

Preferably, the liquid dispensing apparatus further comprises a control unit, controlling movement of the mounting, a receiving surface for receiving dispensed liquid, and one or more sensors operatively connected to the control unit, the one or more sensors arranged substantially in line with a dispensed portion of liquid and being adapted to measure the size of the dispensed portion of liquid and relay corresponding data to the control unit to stop, pause or reverse progressive movement of the mounting and thereby stop or pause further dispensing of the liquid.

Reversing progressive movement of the mounting advantageously reduces pressure in the bag and therefore ensures that the flow of liquid from the nozzle is stopped. Preferably, the one or more sensors is adapted to record a cross-sectional measurement of the dispensed portion of liquid and wherein the control unit is adapted to derive the volume of the dispensed portion of liquid from the cross-sectional measurement.

Preferably, at least one of the one or more sensors is adapted to measure the height and radius of the dispensed liquid.

Preferably, the one or more sensors includes a proximity or position sensor.

Preferably, the proximity or position sensor is an optical sensor.

Preferably, the one or more sensors includes a weight sensor.

According to another aspect of the present invention, a liquid dispensing system is provided in which desired and precise dosage amounts of liquid can be achieved by squeezing liquid out of a plastic film bag through a nozzle attached to the bag at its dispensing end. Specifically, the squeezing is achieved by rolling or winding the tail or end of the bag opposite to the nozzle in the direction of the nozzle. To enable winding or rotation of the bag and to preserve the stationary position of the nozzle needed for precise dosing, the tail of the bag is mounted to a mobile reel of a winding mechanism and simultaneous rotation and forward movement of the reel causes gradual tail to nozzle squeezing of the bag so that the bag may be emptied of desired amounts of its contents.

According to yet another aspect of the present invention there is provided a system for dispensing liquid from a squeeze bag, comprising a rotatable reel for mounting a tail of the squeeze bag thereto, and measures for simultaneously rotating and moving the reel in a forward direction so as to squeeze the bag and dispense liquid from a nozzle of the bag, whereby the squeezing of the bag is so controlled as to dispense precise dosage amounts of liquid therefrom.

Other features that are considered as characteristic for the invention are set forth in the appended claims.

Although the invention is illustrated and described herein as embodied in a liquid dispensing apparatus, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

Notwithstanding any other forms which may fall within the scope of the present invention, preferred embodiments of the invention will now be described, by way of example only, with reference to the accompanying drawings in which:

FIG. 3 is a schematic side elevational view of the liquid dispensing apparatus of FIG. 2 showing the bag held in a second position prior to squeezing, FIG. 4 is a schematic side view of the liquid dispensing apparatus of FIG. 2 showing the tail of the bag mounted to a reel or mobile core of the liquid dispensing apparatus and being wound in the direction of a nozzle of the bag, FIG. 5 is a fragmentary, enlarged view of the region A of the liquid dispensing apparatus of FIG. 4, FIG. 6 is a fragmentary, enlarged view of a central region B of the liquid dispensing apparatus of FIG. 4 where the bag is at a later stage of being wound (in the direction of the nozzle of the bag) as compared to FIG. 5.

FIG. 20 is a schematic top elevational view of an exemplary proximity sensor arrangement for use with a liquid dispensing apparatus in accordance with one exemplary embodiment of the invention, FIG. 21 is a schematic side elevational view of the arrangement shown in FIG. 20, FIG. 22 is a schematic top elevational view of an exemplary camera sensor arrangement for use with a liquid dispensing apparatus in accordance with one exemplary embodiment of the invention, FIG. 23 is a schematic side elevational view of the arrangement shown in FIG. 22, FIG. 24 is a view taken from the camera sensor shown in FIGS. 22 and 23 of the product dispensed from the bag of FIG. 1, and FIG. 25 is a cross-sectional view of the product shown in FIG. 24.

DETAILED DESCRIPTION OF THE DRAWINGS

Figure 1:
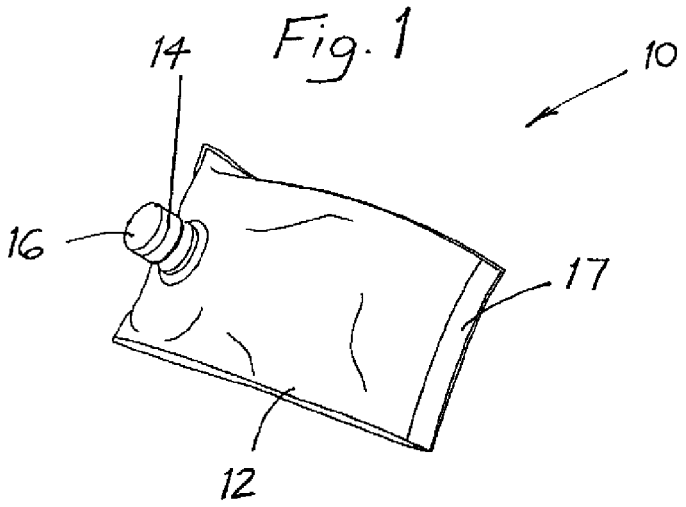
FIG. 1 is a perspective view of a preferred bag for use in a liquid dispensing apparatus in accordance with one embodiment of the invention.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention.

Before the present invention is disclosed and described, it is to be understood that the terminology used herein is for the purpose of describing particular embodiments only and is not intended to be limiting. It must be noted that, as used in the specification and the appended claims, the singular forms "a," "an," and "the" include plural references unless the context clearly dictates otherwise.

While the specification concludes with claims defining the features of the invention that are regarded as novel, it is believed that the invention will be better understood from a consideration of the following description in conjunction with the drawing figures. The figures of the drawings are not drawn to scale.

Throughout this description, where different embodiments are described that have a common, similar or analogous part or feature, that part or feature is indicated with a similar reference numeral (e.g. 10, 10A, 10B etc.).

Referring to the figures, a liquid dispensing apparatus is provided comprising a mobile rotatable core 18 for squeezing a squeeze bag 10 supported by a support structure.

The squeeze bag 10 (or plastic film bag) shown in FIG. 1 comprises a squeezable bag portion 12 and a nozzle 14 (or spout) at one end, the nozzle 14 being protected by a cap 16. The nozzle 14 has a non-return valve or one way valve (not shown), for example a duck-bill valve. The end or tail 17 of the bag 10 opposite to the end having the nozzle 14 has an area adapted for mounting to the mobile rotatable core 18 of the liquid dispensing apparatus.

The nozzle 14 helps to control and direct the flow of liquid out of the flexible bag 10 in use. In other embodiments, the nozzle 14 may be provided at different locations on the bag 10. The protective cap 16 may be fitted to the nozzle 14 during storage, transportation and delivery of the bag 10.

Figure 2:
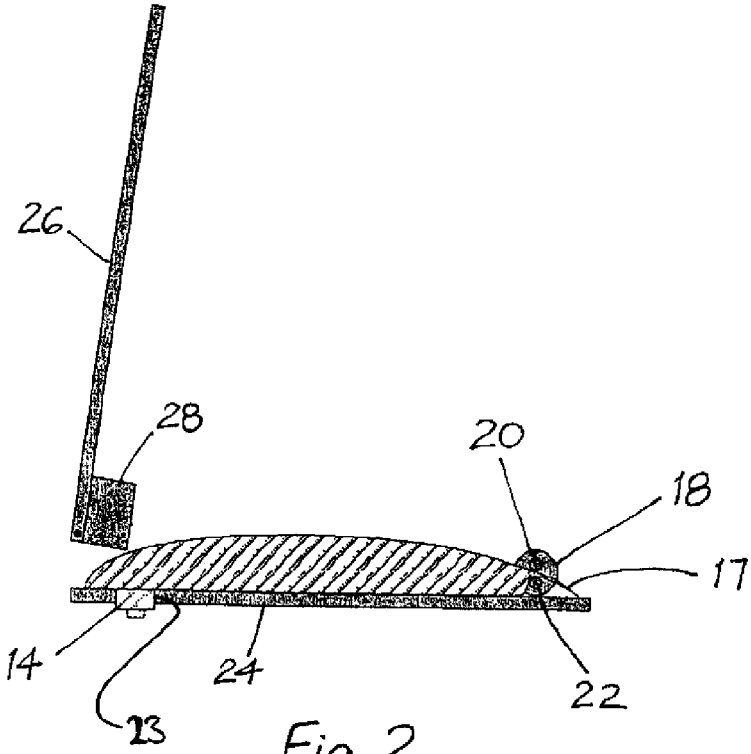
FIG. 2 is a schematic side elevational view of a liquid dispensing apparatus of one exemplary embodiment of the invention, shown holding the bag of FIG. 1 in a first position prior to squeezing.

The mobile rotatable core 18 of the liquid dispensing apparatus shown in FIG. 2 has two fingers 20, 22 which sandwich the tail 17 of the bag 10.

The nozzle 14 of the bag 10 protrudes through an aperture 23 in the support structure, in this case a flat platen 24 on which the bag 10 rests in use. The nozzle 14 also provides a fitting indicator insomuch as once it is fitted within the aperture 23 in the flat platen 24, the flexible bag 10 can be correctly positioned on the flat platen 24, ready to be connected to the core 18. The flat platen 24 is advantageous in that it supports the weight of the bag 10. If the weight of the bag 10 were not so supported then it would need to be supported at its tail 17 by the core 18 and at the nozzle 14 by the aperture 23. In such an arrangement, in order for the bag 10 to be held in a taut, non-sagging manner (which benefits accurate dosing), the core 18 and nozzle 14 would need to provide high opposing forces, which would, in turn, place undue stress on the apparatus.

There is a hinged lid 26 having a nozzle holding portion 28 that maintains the nozzle 14 through the aperture 23, particularly when the flexible bag 10 is tensioned as the core 18 progressively winds up the bag 10. That is, the nozzle holding portion 28 helps the nozzle 14 support a higher reaction force against the pull of the flexible bag 10 as it is progressively wound up. Higher tension in the flexible bag 10 enables even better extraction of liquid from the flexible bag 10. However, too much tension can stop or potentially damage the driving mechanism (described below), motor (described below), flexible bag 10 or nozzle 14.

In another embodiment, the nozzle 14 does not protrude all the way through the aperture 23 and, in this embodiment, the aperture 23 can act as an extension of the nozzle 14.

In use, the bag 10 is placed on the surface of the platen 24 and the nozzle 14 is located through the aperture 23 in the platen 24 so that it may serve as a dispensing outlet. The tail 17 of the bag 10 is mounted to the core 18 by passing the tail between the two fingers 20, 22. The hinged lid 26 is then laid flat on the bag 10 (see FIG. 3) so as to constrain the bag between upper and lower rigid surfaces of the lid 26 and platen 24, respectively. This provides a convenient way of limiting expansion of the bag 10 by sandwiching the largest planes of the bag 10 in use.

Thus, excessive expansion of the bag 10 under pressure from squeezing by the mobile rotatable core 18 is avoided or at least reduced. This enables dosing to be more accurately controlled.

The hinged lid 26 allows the core 18 and flat platen 24 to be readily accessed in use (or between use) and thus the bag 10 to be readily fitted to or removed from the apparatus.

The core 18 is caused to simultaneously rotate and move in a forward direction towards the nozzle 14 as shown in FIGS. 4 and 5, and the tail 17 of the bag 10 then starts to wind or wrap around both fingers 20,22 of the core 18. The more the core 18 rotates, the more liquid is squeezed through the nozzle 14 and out of the bag 10 by the increasing pressure inside the bag (see FIG. 6).

Figure 7:
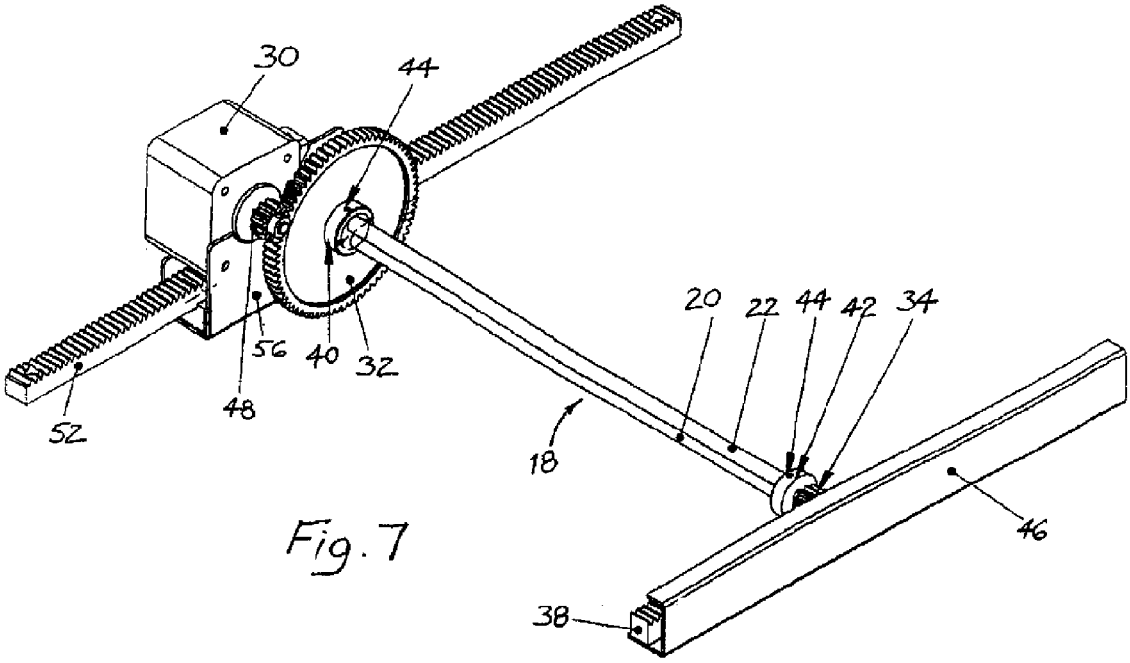
FIG. 7 is a perspective view of another exemplary liquid dispensing apparatus in accordance with one embodiment of the invention.
Figure 8:
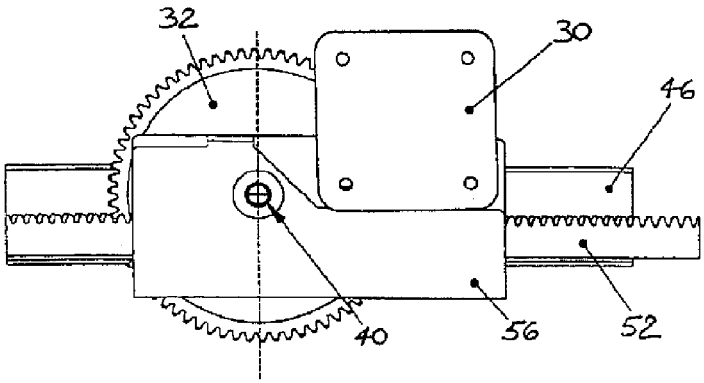
FIG. 8 is a fragmentary, left side elevational view of a portion of the liquid dispensing apparatus of FIG. 7.
Figure 9:
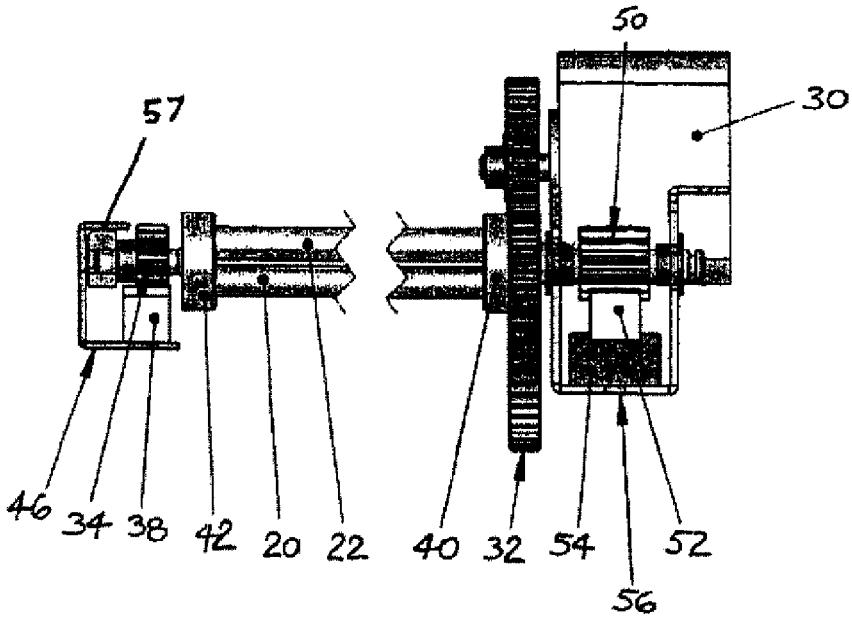
FIG. 9 is a partly broken away, right end elevational view of the liquid dispensing apparatus of FIG. 7.

Referring to FIGS. 7 to 9, the core 18 is powered by a reversible direction electric stepper motor 30. In some embodiments, to properly close the one-way valve arrangement of the nozzle 14, the electric motor 30 must be reversed for a short period of time. Reversing the electric motor 30 relieves pressure from within the flexible bag 10 and thus stops liquid being urged out of it.

The mobile rotatable core 18 comprises two fingers 20, 22. The fingers 20, 22 are connected at one end to a cradle shaft 40 and at the other end to an end shaft 42 by respective spring pins 44.

The end shaft 42 is connected to a first rack travelling gear 34 that is adapted to travel along the rack 38. The rack 38 is supported inside a bag slide channel 46. The cradle shaft 40 is connected to a second rack travelling gear 50 (see, e.g., FIGS. 9 and 10) that is adapted to travel along the rack 52. Thus, there are gears 34, 50 on both ends of the core 18.

A gear 32 rotationally fixed with respect to the cradle shaft 40 engages a second small diameter gear 48 which rotates with the output shaft of the stepper motor 30. The gear 32 is used to reduce the speed of rotation of the cradle shaft 40 by gearing-down the stepper motor 30 speed. It should be appreciated that a different gearing arrangement could be used between the stepper motor 30 and the cradle shaft 40 depending on the required gear ratio.

The first and second rack travelling gears 34, 50 permanently contact and travel on gear racks 38, 52 ensuring that they simultaneously rotate and move in a forward direction towards the nozzle 14 of the bag 10 being squeezed by the operation of the above described winding mechanism. The inclusion of the first and second rack travelling gears 34, 50 and gear racks 38, 52 ensures that no slippage occurs.

The rack 52 is supported on a plastic slide 54 which is housed in a cradle 56 located beneath the motor 30.

A bearing surface 57 is also provided that stops the first rack travelling gear 34 from disengaging gear rack 38. The second rack travelling gear 50 is held against the rack 52 by the cradle 56.

Operating the motor 30 causes the small diameter gear 48 to rotate which, in turn, causes the large diameter gear 32 to rotate. As the large diameter gear 32 rotates, so does the core 18, and the core 18 moves forward along the racks 38, 52 by consequential rotation of the gears 34, 50. In one embodiment, this drive system provides automatic squeezing of the flexible bag 10 either in whole or in steps depending on user selection. There is a clear advantage in terms of having the flexible bag 10 squeezed by a drive system (as opposed to being wound up manually) in terms of preciseness of dosage and general ease of use of the liquid dispensing apparatus.

Figure 10:
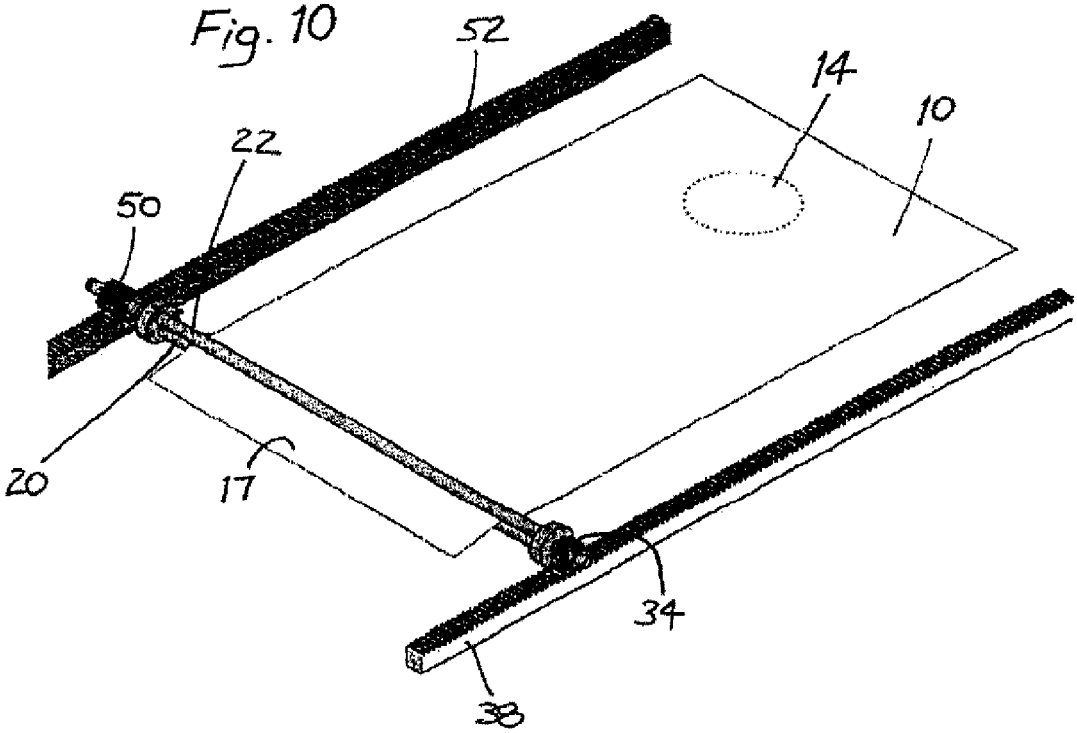
FIG. 10 is a fragmentary, perspective view of a portion of the liquid dispensing apparatus of FIGS. 7 to 9 holding the bag of FIG. 1 prior to squeezing.

When the tail 17 of the bag 10 is mounted between the fingers 20,22 of the core 18 (as shown in FIG. 10), rotation and forward movement of the core 18 causes the tail 17 to wrap around the core 18, followed by further winding of the bag 10 and the squeezing of its contents through the nozzle 14.

Figure 11:
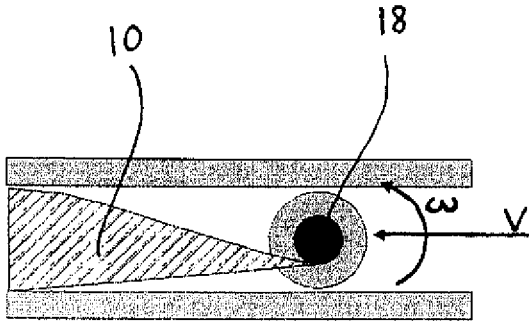
FIG. 11 is a fragmentary, schematic, cross-sectional view through a portion of a liquid dispensing apparatus in accordance with one exemplary embodiment of the invention.

In the depicted embodiment, as the core 18 travels towards the nozzle 14, it picks up the slack from the end of the bag 10 and keeps the bag 10 in slight tension. A simplified representation of this process is shown in FIG. 11.

Figure 12:
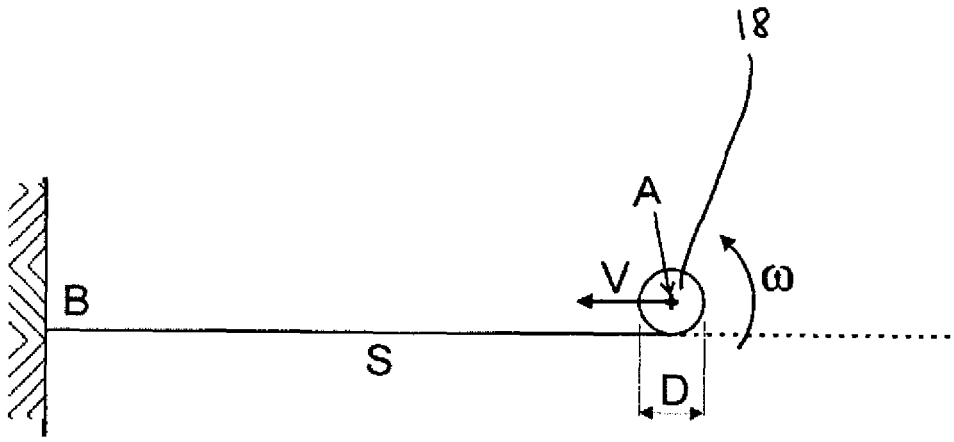
FIG. 12 is a schematic diagram illustrating the physical principles relating to movement of a reel or core of a liquid dispensing apparatus in accordance with one exemplary embodiment of the invention.

The physical principles which underpin this process are shown in FIG. 12. The core 18 is rolling with a rotational velocity "ω" along the surface "S" towards fixed point "B". The core 18 picks up the slack of the bag 10. In theory, if the diameter "D" of the core 18 is constant (i.e. thickness of bag 10A=0) then the core 18 having a centre "A" travels πD per rotation.

Figure 13:
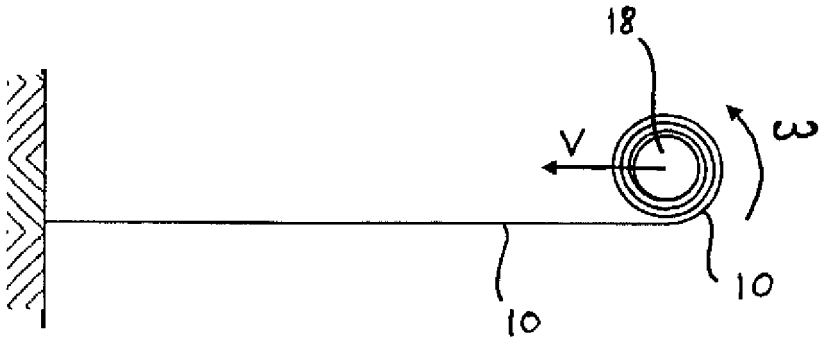
FIG. 13 is a schematic diagram illustrating the physical principles relating to movement of a reel or core of a liquid dispensing apparatus in accordance with another exemplary embodiment of the invention.

In practice, the material of the bag 10 that wraps around the core 18 causes the core 18 diameter D to increase continuously as shown in FIG. 13, while the linear advancement of the core 18A is governed by its gear to rack ratio, which is constant per rotation.

In effect, for each turn of the core 18, the core 18 advances further than the previous turn. If the rotational velocity of the core (ω) is constant, the linear velocity (V) of the core's center A, increases.

The distance of travel per rotation of core center A is defined by πD.

Figure 14:
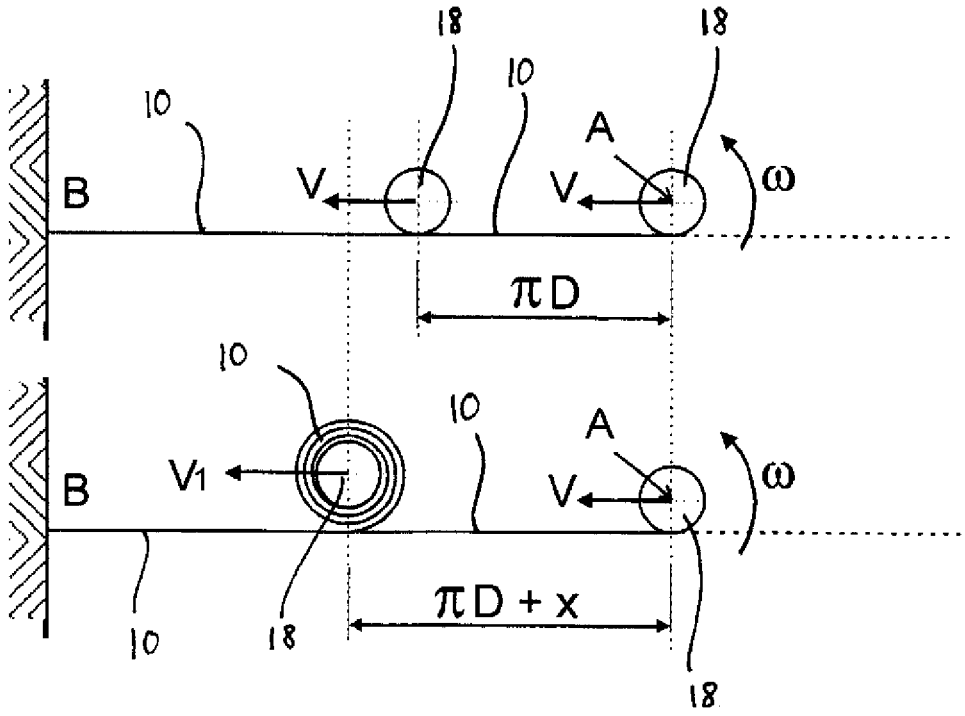
FIG. 14 is a pair of schematic, cross-sectional diagrams illustrating the physical principles relating to movement of a reel or core of a liquid dispensing apparatus in accordance with another exemplary embodiment of the invention.

Referring to FIG. 14, a displacement discrepancy value "x" arises from the thickness (or increase in overall diameter) of the wound up bag 10.

Figure 15:
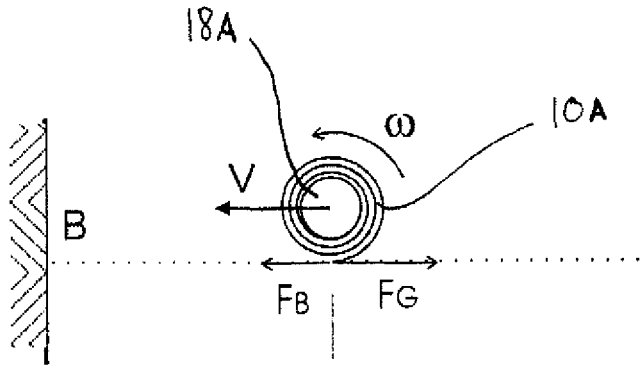
FIG. 15 is a schematic diagram illustrating the physical principles relating to movement of a reel or core of a liquid dispensing apparatus in accordance with still another exemplary embodiment of the invention.

In practice, for each turn of the core 18, the apparatus requires the core to move πD+x, with the accelerated centre A velocity V1. However the core 18 can only move the distance allowed by the gear to rack ratio=πD (i.e. if the gear's pitch circle diameter (PCD)=D). Referring now to FIG. 15, this discrepancy produces a pull of the bag (FB) opposing the force of the gear (FG) exerted on the rack, and causes the bag 10 to be tensioned. As the core 18 continues to rotate and move towards the nozzle 14, this discrepancy, and therefore the load, increases. This can prevent the advancement of the core 18 if the load becomes significant.

One solution to this discrepancy is to provide a core 18A having an initial diameter smaller than D, in anticipation of the diameter growing. One drawback with this solution is that there would be too much slack in the bag 10A initially and the emptying of the bag 10A would not be as effective, or at least difficult to control.

Referring now to FIGS. 16 to 19, a number of effective solutions are proposed to prevent opposing forces causing damage to the mechanism or to the bag 10A.

A first solution proposed by the present invention is a means for changing the diameter of the core 18 relative to the load. The diameter of the core 18 is initially large enough to eliminate slack in the bag 10 but collapses relative to the tension/load, decreasing its diameter to compensate for the increasing thickness of the wound-up bag 10. This can be achieved by employing a variable diameter/collapsible/shrinkable core 18. Advantageously, a core 18 of variable effective diameter can reduce in diameter as tension in the bag 10 increases. This means that the tension will not increase to a level that excessively hinders forward movement of the core 18 (i.e. towards the outlet of the bag 10).

Different embodiments of a variable diameter core 18 will now be described.

Figure 16:
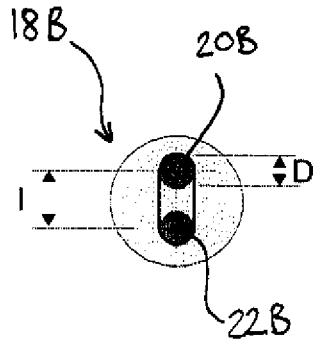
FIG. 16 is a cross-sectional view through a reel or core of a liquid dispensing apparatus in accordance with one exemplary embodiment of the present invention in a normal form.
Figure 17:
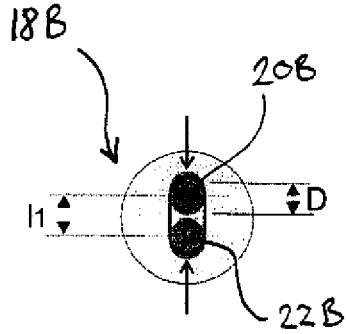
FIG. 17 is a cross-sectional view through the core of FIG. 16 in a reduced diameter form.

Referring to FIGS. 16 and 17, a core 18B is shown and comprises two flexible rods or fingers 20B, 22B which define a slot therebetween for receiving the tail 17 of the flexible bag 10 in use. Advantageously, once the tail 17 of the flexible bag 10 is woven between the fingers 20B, 22B, the flexible bag 10 can be rotated by the fingers 20B, 22B and friction will stop the tail 17 from sliding out of the slot.

The rods 20B, 22B are made from a resilient material such that the gap between the rods (i.e. width of the slot) decreases under load, and thus with the pulling force of the bag 10. Under sufficient bag 10 tension, the rods 20B, 22B may collapse such that center portions of the rods 20B, 22B are located adjacent each other. In this embodiment, the rods 20B, 22B are made from aluminum but in other embodiments they may be made from other suitable engineering materials (e.g. polycarbonate, polyethylene, copper, wood).

Therefore, the equivalent diameter decreases as a function of the load force. The deformation is small enough for the rods 20B, 22B to come back to their initial straight shape after the force is removed.

Advantageously, this represents a simple and cost-effective manner of providing a variable diameter core 18B in use.

The decrease in effective diameter is illustrated by FIGS. 16 and 17 in terms of a decrease in equivalent circumference which is a result of a decrease in effective diameter. In FIG. 16 the equivalent circumference is $\pi D+2I$ while in FIG. 17 the equivalent circumference is $\pi D+2I1$.

An Example:

If the gear Module=1, the gear has 12 teeth and the gear's PCD=12 mm, the equivalent circumference should be $\pi D$. Therefore, $\pi \times 12$ mm=37.68 mm.

If the aluminum rods are 6 mm in diameter and the formula for Equivalent Circumference=$C=\pi D+2I$, then $I=(C-\pi D)/2$ and the distance between the rods' centers should be 9.4 mm.

Therefore, the theoretical gap between the rods=9.4 mm−6 mm=3.4 mm.

This particular arrangement/geometry is only applicable to a limited range of bag lengths. The gap between the rods 20B, 22B and the rods' diameters is fixed for a given bag length. Generally, the longer the bag 10, the larger the gap will need to be and/or the smaller the rod diameter will need to be (in both cases to allow for greater displacement of the rods towards each other).

Figure 18:
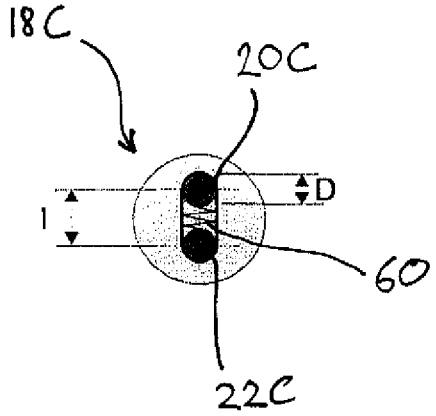
FIG. 18 is a cross-sectional view through a spring-loaded reel or core of a liquid dispensing apparatus in accordance with another exemplary embodiment of the present invention in a normal form.

Referring to FIG. 18, an embodiment is provided that is similar to the embodiment shown in FIG. 16 with the exception that at least one biasing device, in this case a single spring 61, is provided between the rods 20C, 22C. Thus, the decrease (or collapse) in effective diameter is achieved by the movement of the rods 20C, 22C, with tension regulated by the spring 61. It should be noted that the spring 61 may either be a compression or tension spring depending on the particular arrangement. In another embodiment, the spring 61 could be replaced by a material with elastic, compressible bulk properties (e.g. visco-elastic foam). This embodiment may be utilized with a variety of different bag lengths.

Figure 19:
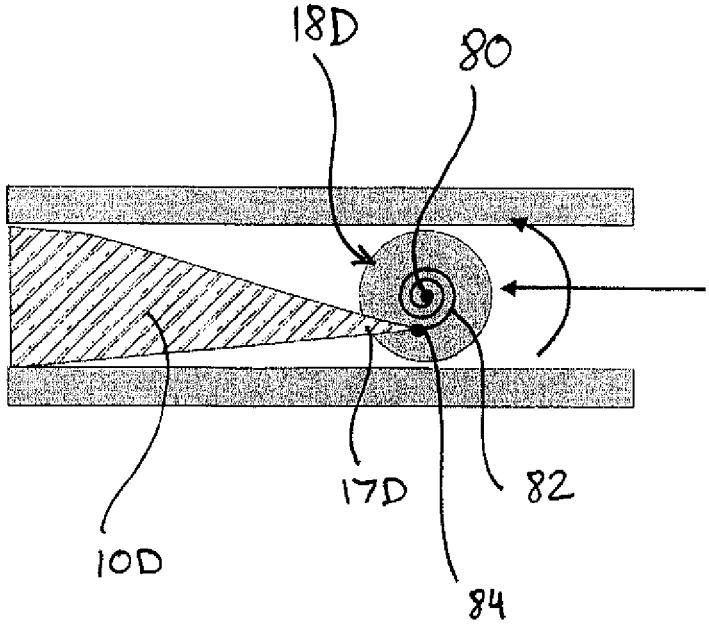
FIG. 19 is a fragmentary, cross-sectional view through a liquid dispensing apparatus comprising a spiral spring-loaded reel or core in accordance with one exemplary embodiment of the present invention.

Another embodiment is depicted in FIG. 19 and provides a core 18D having a single rod 80 or finger. The decrease (or collapse) in effective diameter of the core 18D is achieved by the compression of a spiral spring 82 that runs along the rod 80. A tail of the bag 17D is fixed/locked to an edge 84 of the spiral spring 82. The tension in the bag 10D is regulated by the spiral spring 82. This embodiment may be utilized with a variety of different bag lengths.

A second potential method for preventing damage to the mechanism or bag due the above mentioned opposing forces is to provide measures for allowing rack movement to compensate for the load. For example, each rack 38, 52 may be slidably mounted on a rail and biasing measures may be provided to connect the racks 38, 52 and their respective rails or any other suitable stationary structure of the apparatus so that the racks 38, 52 can only move with respect to the rails against the bias of the biasing device. In one embodiment, the biasing device is a tension spring. Thus, in this embodiment the tension resulting from discrepancy of core movement is compensated for by movement of the racks 38, 52.

A third method for preventing damage to the mechanism or bag due the above mentioned opposing forces is to provide measures for allowing the nozzle 14 and/or aperture 23 to move by a small amount. For example, the aperture 23 could have an obround cross-section and include a biasing device (e.g. a spring) to bias the nozzle 14 away from the moving core 18. In the case that the biasing device comprises a compression spring, the spring compresses as tension in the bag 10 increases thus limiting tension in the bag 14. A tension spring may be mounted to the other side of the nozzle 14 to serve a similar purpose.

Referring now to FIGS. 20 to 25, the liquid dispensing apparatus further comprises a control unit 58*a* controlling movement of the core 18, a receiving surface 59 for receiving dispensed liquid, and one or more sensors operatively connected to the control unit 58*a*. The receiving surface 59 may be provided by a conveyor as shown.

One aspect of the liquid dispensing apparatus relates to a sensor system for precise dosing of liquid from the bag 10 as described by one of the embodiments below.

Squeezing liquid from the bag 10 is generally not proportional to advancement of the core 18. This is due to expansion of the bag 10 and the residual pressure in the bag 10 after reversing the core 18.

A solution to these problems is to arrange the one or more sensors to control the size of the dose. The one or more sensors may be a position, weight, volume, ultrasonic, infrared or temperature sensor, or any other suitable type of sensor.

In one embodiment, the one or more sensors are substantially in line with a dispensed portion of liquid and are adapted to measure the size of the dispensed portion of liquid and relay corresponding data to the control unit to stop, pause or reverse progressive movement of the core 18 and thereby stop or pause further dispensing of the liquid. The one or more sensors may be arranged and/or adapted to measure the height and/or radius of the dispensed liquid.

In one embodiment, the one or more sensors is a proximity sensor, a camera sensor and/or optical sensor. A camera sensor is particularly suitable where a relatively high viscosity fluid is being dispensed (e.g. pancake mix). In one embodiment, the one or more sensors is an optical sensor that uses modulated infra-red light. In one embodiment, the one or more sensors is a single sensor comprising an infra-red light and a receiver.

As shown in FIGS. 11 and 12 relating to a proximity sensor, the liquid squeezed from the bag 10 falls on the receiving surface 59.

The proximity sensor 58 positioned off the center (reflective or through beam) detects the edge (or diameter) of squeezed liquid 60. The triggering of the sensor upon such detection causes the core 18 to retract/reverse rapidly to release the pressure in the bag 10 and stop flow through the nozzle 14.

Precision of dosing can be improved with a lower speed of the flow. To achieve a lower speed of the flow, the speed of the core 18 can be lowered. Additional sensor(s) can be used to control flow of the liquid squeezed from the bag 10. Presence of flow can be detected by the proximity sensor(s), causing (through electronic control) a decrease in the speed of the core 18. That is, at least in one embodiment liquid can be dispensed at a variable rate. This can help provide more accurate dosing as after most of the liquid has been deposited through the nozzle to make a single food item, the rate can be decreased then stopped, or taper down gradually to a stop.

In the case of liquids of high density, and especially of variable density (between batches), the measurement of the diameter of the deposited liquid could be insufficient to achieve precise dosage dispensing.

Referring to FIGS. 13 to 16 a camera sensor 62 (see FIGS. 22 and 23) is provided and can be used for calculating the volume of the deposited liquid. The camera 62 is positioned close to the deposit (as shown) and scans (in real time) the silhouette/contour of the squeezed liquid. The image of the approximate cross-section can be used to derive the actual volume. A high speed processor interprets the image from the camera in real time and calculates the volume (Volume of a Solid of Revolution). At the reaching of a pre-set volume, the processor sends a signal to reverse the core 18 and stop the squeezing process. A camera sensor 62 may be used in conjunction with or independently from a proximity sensor 58 (see FIGS. 20 and 21).

In this embodiment, the flexible bag 10 is made from multilayer film. An outer layer of the film is made from a nylon laminate, while the product contact layer is made from LLD polyethylene. In other embodiments, the bag is made from another food grade plastic or elastomeric material, sealed paper, sealed fabric or Teflon.

In this embodiment, the flexible bag is 325 mm long and 220 mm wide. In other embodiments, the flexible bag may be between 150 mm and 650 mm long and between 100 and 450 mm wide. The flexible bag is not limited to this range of sizes and can be any suitable size to suit the context of use.

In this embodiment, the nozzle 14 is located 50 mm from the front of the bag 10 and is positioned centrally width-wise. In other embodiments, the nozzle is located between 10 mm and 100 mm from the front of the bag and/or is positioned off-center.

In one embodiment, the flexible bag has a variable cross-sectional area such that the dispensing of liquid from the outlet is substantially proportional to progressive winding of the flexible bag in use. Advantageously, this embodiment does not require any sensors and the control unit simply needs to be able to retain information about how far the mounting has progressed. In this embodiment, the bag may be pleated to limit expansion and so to enhance the accuracy of dispensing liquid. Furthermore, the flexible bag may take a trapezoidal shape when viewed from above such that the short parallel end of the trapezoid is adjacent the nozzle. In other embodiments, the flexible bag may take a shape other than generally rectangular.

In yet another embodiment, a nozzle or aperture is formed in the bag by piercing of the wall of the bag in a predetermined area. An adhesive cover that can be peeled off before use may be provided over the nozzle or aperture.

In another embodiment, the rotatable core may or may not be of variable diameter and the nozzle is fitted with a flexible outlet tube, a free end of which is fixed in the aperture 23. Thus, the increase in effective diameter of the rotatable core as the bag is wound around it is compensated for by stretching of the flexible outlet tube.

In yet another embodiment, the nozzle is not fitted with a one-way valve but is attached to a flexible tube which extends initially upwardly from the nozzle and then through an inverted U-bend and then downwardly. This stops liquid flowing out of the bag once squeezing of the bag is stopped. In one variation, an inverted U-bend is provided at any point along the flexible tube but is located and adapted to perform the same function.

In one variation on the invention, the rods 20, 22 are replaced by respective pairs of attachments that clip, clamp or peg onto opposite sides of the flexible bag.

In another embodiment, the mounting takes the form of a rolling pin adapted such that when it is rotated over the bag, liquid is squeezed out of the flexible bag.

In yet another embodiment, the apparatus is arranged vertically instead of horizontally. In this embodiment, the rotatable core is held stationary by the structure and the flexible bag is drawn upwards as the core rotates. The flexible bag has a downwardly facing outlet on one side and the cooking surface is positioned directly below the outlet. The arrangement is such that the liquid being dispensed always lands at substantially the same location on the cooking surface irrespective of the height of the nozzle. To ensure correct positioning of the flexible bag, and to assist squeezing of the bag, the bottom of the bag is pulled downwardly by a weight, spring force or other suitable measures.

It is noted that a core of variable diameter is only necessary where the nozzle is held substantially stationary. It is important to hold the nozzle stationary when the apparatus is arranged at an angle other than vertical and where sensors are used to effectively measure the volume of liquid dispensed.

One advantage of embodiments of the liquid dispensing apparatus is that it can dispense desired & precise dosage portions of liquid because the liquid is gradually squeezed out in a controlled manner. This stands in contrast, for example, to fluid being dispensed under gravity or under action of a pump where volume flow rate can be dependent on hydraulic pressure.

The controlled squeezing from distal portion to proximal portion of the bag can be carried out at varying speeds according to requirement, and accuracy of dosing can be maintained.

Thus, embodiments of the present invention allow dispensing of accurate doses of liquid at a relatively fast rate, substantially irrelevant of the viscosity of the liquid (within a certain range of viscosities). Thus, embodiments of the present invention are well adapted to production lines and production processes. One example of such a production process is the process of preparing a food item (e.g. a pancake). A speedy process will lead to better rates of production of the food items and to greater customer satisfaction.

Another advantage of embodiments of the liquid dispensing apparatus is that is able to substantially completely empty the flexible bag because the bag is maintained in tension as it is wound up from the tail to the nozzle of the bag. This results in less wastage of liquid and subsequently to a reduction in the costs associated with the provision of the liquid.

Another advantage of embodiments of the liquid dispensing apparatus is that it provides direct dosing from the flexible bag. That is, in normal operation the liquid does not contact any unnecessary surfaces of the dispensing apparatus. For example, in the case that the dispensing apparatus is adapted for dispensing portions of food to be cooked, the food is dispensed directly onto the cooking surface or surfaces. Thus, in the case that the bags are discarded once emptied, the apparatus does not need to be regularly cleaned because the liquid does not contact any other components of the apparatus and therefore is also highly hygienic. The fact that the apparatus is adapted to provide direct dosing from the flexible bag means that a flexible tube (as in peristaltic pumps) or other like wearable parts are not required and hence do not need to be replaced.

The apparatus can also be highly hygienic in embodiments where the contents of the bag remain sealed in the bag until dispensed from the bag. Thus, in the context of preparation of food products, the apparatus stands superior of some prior art in terms of health, safety and contamination considerations. In embodiments that include air-tight sealing of the contents of the bag (whether in solid or liquid state) the product is better preserved and shelf-life is increased. This is particularly advantageous in the case that the apparatus is used to dispense food products because of the relatively short shelf-life of food products.

Another advantage of embodiments of the liquid dispensing apparatus is that it is mechanically simple in construction. This is because a dispensing receptacle and associated components (e.g. an attachment, a cover and/or a stirrer) need not be incorporated into the apparatus. This reduces costs and means that the liquid dispensing apparatus can be manufactured in a more compact form, reducing packaging, packing time, and delivery requirements, if relevant. A mechanically simple construction also means that the system is mechanically efficient. This, in turn, reduces power requirements, and thus cost. A mechanically simple construction also provides greater reliability because there are less parts involved.

Another advantage of embodiments of the liquid dispensing apparatus is that the power requirements are relatively low since the relatively small radius mounting (and bag wrapped therearound) only needs to be wound and thus the electric motor has a strong mechanical advantage or leverage. The reduced power requirements mean that the apparatus is less likely to cause injury to a user and can utilize a smaller/cheaper motor. Furthermore, the apparatus will not use as much power, reducing power costs.

Yet another advantage of embodiments of the liquid dispensing apparatus that utilize a bag which is disposed of once emptied, is that usage is simplified since refilling steps and cleaning steps are not involved. This results in a high level of convenience of use. Convenience for the owner of the machine is further enhanced because bags of liquid or powder (e.g. for mixing with water to make the liquid) can be sent to them, ready or near ready for use. For example, the bag may be connected to the dispensing apparatus in one or two simple steps, and water may be added to the contents of the bag if necessary beforehand.

The arrangement also allows for easy mixing with water as once water has been added to the bag, the bag can be shaken with a lid over the nozzle and then connected to the apparatus once the contents are properly mixed. Furthermore, if the flexible bag is made from a clear material, a user can see whether the contents are properly mixed and because the flexible bag is flexible, a user can feel whether the contents are properly mixed. If the contents are not properly mixed then the user can carry out further shaking to mix the contents of the bag.

It will be readily apparent to persons skilled in the art that various modifications may be made in details of design and construction of the liquid dispensing apparatus described above without departing from the scope or ambit of the invention. For example, although in the depicted embodiment the liquid to be dispensed is stored in a flexible bag, it may also be stored in other flexible containers.

In one embodiment, the electric motor 30 is adapted to be driven at variable speeds.

It should be understood that the word "liquid" as used in this specification refers to any flowable substance and includes foods having flowable characteristics that may be of variable viscosity, such as the batter used to make pancakes.

It should be noted that in this specification the words "reel" and "core" have the same meaning and are used interchangeably.

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

The invention claimed is:

1. A liquid dispensing apparatus for dispensing a liquid from a flexible bag, comprising:

a support for supporting the flexible bag in use, and a mounting adapted for receiving a proximal portion of the flexible bag and for simultaneous progressive movement relative to the support towards an outlet located at a distal portion of the flexible bag, and winding of the flexible bag, wherein the support comprises at least one rail and the mounting comprises at least one roller adapted for rolling along the at least one rail and a reel of variable effective diameter, being adapted to reduce in effective diameter as tension in the bag increases, the reel comprising a plurality of members where at least one of the members is compressible, resiliently displaceable, or resiliently compressible, such that the flexible bag can be progressively wound up and liquid can be squeezed from the proximal portion to the distal portion and dispensed from the outlet in a controlled manner in use.

2. A liquid dispensing apparatus as claimed in claim 1, wherein the outlet comprises a nozzle, and the support comprises an aperture for receiving the nozzle in use.

3. A liquid dispensing apparatus as claimed in claim 2, wherein the aperture is shaped to permit the nozzle to extend through the aperture.

4. A liquid dispensing apparatus as claimed in claim 2, wherein the aperture comprises a retainment shaped to releasably retain the nozzle in the aperture.

5. A liquid dispensing apparatus as claimed in claim 1, further comprising a drive system operable for moving the mounting towards the distal portion of the flexible bag and for progressively winding up the flexible bag from the proximal portion to the distal portion.

6. A liquid dispensing apparatus as claimed in claim 1, wherein the support comprises a lower portion for supporting the flexible bag from below and at least one expansion limiting portion for limiting expansion of the bag in use.

7. A liquid dispensing apparatus as claimed in claim 6, wherein the lower portion is an under surface and the at least one expansion limiting portion is an upper surface spaced above the lower surface and adapted to resist expansion of the flexible bag in use.

8. A liquid dispensing apparatus as claimed in claim 7, wherein the upper surface has an end and is hinge mounted at the end to the support.

9. A liquid dispensing apparatus as claimed in claim 8, wherein:

the outlet comprises a nozzle;

the support comprises an aperture for receiving the nozzle in use; and the upper surface includes a protrusion extending downwardly and shaped to maintain the nozzle in the aperture.

10. A liquid dispensing apparatus as claimed in claim 1, wherein the plurality of members comprises at least two spaced apart, elongate mounting members that define a slot therebetween for receiving the proximal portion of the flexible bag in use.

11. A liquid dispensing apparatus as claimed in claim 10, wherein at least a portion of at least one of the mounting members is made from a resilient material such that as the flexible bag is progressively wound around the mounting members, the at least one of the mounting members flexes and the distance between the mounting members reduces, thus reducing the effective diameter of the reel.

12. A liquid dispensing apparatus as claimed in claim 1, wherein the mounting comprises two rollers and the plurality of members comprises two mounting members and each roller is connected directly to adjacent ends of the mounting members or indirectly to adjacent ends of the mounting members.

13. A liquid dispensing apparatus as claimed in claim 12, wherein the mounting members have intermediate regions and a biasing arrangement connects the intermediate regions.

14. A liquid dispensing apparatus as claimed in claim 13, wherein the biasing arrangement is at least one compression spring.

15. A liquid dispensing apparatus as claimed in claim 13, wherein the biasing arrangement is at least one tension spring.

16. A liquid dispensing apparatus as claimed in claim 1, wherein the plurality of members comprises at least one shaft and at least one resiliently compressible spring interconnecting the at least one shaft and the proximal portion of the flexible bag such that, as the flexible bag is progressively wound up, the at least one spring compresses reducing the effective diameter of the reel.

17. A liquid dispensing apparatus as claimed in claim 16, wherein the spring is a spiral spring that surrounds at least a portion of the at least one shaft and has an inner edge mounted to the at least one shaft and an outer edge adapted to be attached to the proximal portion of the flexible bag such that, as the flexible bag is progressively wound around the spiral spring, the spiral spring compresses reducing an effective diameter of the spiral spring, thus reducing the effective diameter of the reel.

18. A liquid dispensing apparatus as claimed claim 5, wherein the drive system is adapted to rotate the at least one roller along the at least one rail.

19. A liquid dispensing apparatus as claimed in claim 18, wherein the drive system comprises an electric step motor and a control unit.

20. A liquid dispensing apparatus as claimed in claim 18, wherein the support comprises two rails and the mounting comprises two rollers and the reel is mounted between and has ends connected to respective rollers.

21. A liquid dispensing apparatus as claimed in claim 20, wherein the rollers and rails include gear teeth that are adapted to mesh with each other thereby ensuring forward movement of the mounting occurs with rotation of the mounting.

22. A liquid dispensing apparatus as claimed in claim 1, wherein the flexible bag is made from at least one of a food grade plastic, elastomeric material, sealed paper, sealed fabric, rubber, and Teflon.

23. A liquid dispensing apparatus as claimed in claim 22, wherein the flexible bag has a variable cross-sectional area such that the dispensing of liquid from the outlet is substantially proportional to progressive winding of the flexible bag in use.

24. A liquid dispensing apparatus as claimed in claim 1, further comprising a control unit operable to control movement of the mounting, a receiving surface for receiving dispensed liquid, and one or more sensors operatively connected to the control unit, the one or more sensors arranged substantially in line with a dispensed portion of liquid and being adapted to measure the size of the dispensed portion of liquid and to relay corresponding data to the control unit to stop, pause or reverse progressive movement of the mounting and thereby stop or pause further dispensing of the liquid.

25. A liquid dispensing apparatus as claimed in claim 24, wherein the one or more sensors is adapted to record a cross-sectional measurement of the dispensed portion of liquid and wherein the control unit is adapted to derive the volume of the dispensed portion of liquid from the cross-sectional measurement.

26. A liquid dispensing apparatus as claimed in claim 24, wherein at least one of the one or more sensors is adapted to measure the height and radius of the dispensed liquid.

27. A liquid dispensing apparatus as claimed in 24, wherein the one or more sensors includes at least one of a proximity sensor and a position sensor.

28. A liquid dispensing apparatus as claimed in claim 27, wherein the one or more sensors includes an optical sensor.

29. A liquid dispensing apparatus as claimed in claim 24, wherein the one or more sensors includes a weight sensor.

30. A liquid dispensing apparatus to be used with a flexible bag having a proximal portion, a distal portion and an outlet at the distal portion for removing liquid from within the flexible bag, the liquid dispensing apparatus comprising:

a bag support shaped to support the flexible bag while dispensing fluid from the flexible bag, the bag support having at least one rail; and a mounting comprising:

at least one roller shaped to roll along the at least one rail; and a reel:

shaped to receive the proximal portion of the flexible bag and upon which the flexible bag can be progressively wound;

operable to wind the flexible bag thereat from the proximal portion toward the outlet at the distal portion and simultaneously progressively move relative to the bag support towards the outlet; and having a variable effective diameter that reduces in diameter as tension in the bag increases while the flexible bag is being progressively wound thereat and while liquid is being squeezed in a direction from the proximal portion to the distal portion and thereby dispensed from the outlet in a controlled manner that is dependent upon the progressive movement relative to the bag support, the reel comprising a plurality of members where at least one of the members is compressible, resiliently displaceable, or resiliently compressible.

31. In combination with a flexible bag having a proximal portion, a distal portion and an outlet at the distal portion for removing liquid from within the flexible bag, a liquid dispensing apparatus, the improvement comprising:

a bag support shaped to support the flexible bag while dispensing fluid from the flexible bag, the bag support having at least one rail; and a mounting comprising:

at least one roller shaped to roll along the at least one rail; and a reel:

shaped to receive the proximal portion of the flexible bag and upon which the flexible bag can be progressively wound;

operable to wind the flexible bag thereat from the proximal portion toward the outlet at the distal portion and simultaneously progressively move relative to the bag support towards the outlet; and having a variable effective diameter that reduces in diameter as tension in the bag increases while the flexible bag is being progressively wound thereat and while liquid is being squeezed in a direction from the proximal portion to the distal portion and thereby dispensed from the outlet in a controlled manner that is dependent upon the progressive movement relative to the bag support, the reel comprising a plurality of members where at least one of the members is compressible, resiliently displaceable, or resiliently compressible.

* * * * *